US006012613A

United States Patent [19]

Chen

[11] Patent Number: 6,012,613

[45] Date of Patent: Jan. 11, 2000

[54] EXTRUDING MECHANISM FOR AUTO DISPENSER

[76] Inventor: Yi-Chen Chen, 68-31 Yian-Chi Street, Taipei, Taiwan

[21] Appl. No.: 09/159,589

[22] Filed: Sep. 24, 1998

[51] Int. Cl.[7] ..... G01F 11/00

[52] U.S. Cl. ..... 222/207; 222/180; 222/182; 222/214; 222/309; 222/380; 222/476; 222/333

[58] Field of Search ..... 222/180–181.3, 222/182, 185.1, 207, 214, 309, 380, 383.1, 476, 333

[56] References Cited

U.S. PATENT DOCUMENTS

| | | | |
|---|---|---|---|
| 2,849,159 | 8/1958 | Kaufmann | 222/309 |
| 3,809,293 | 5/1974 | Chappell | 222/181.2 |
| 4,360,130 | 11/1982 | Nishimura et al. | 222/181.2 |
| 4,527,437 | 7/1985 | Wells | 222/214 |
| 4,561,571 | 12/1985 | Chen | 222/207 |
| 5,186,360 | 2/1993 | Mease et al. | 222/63 |
| 5,379,813 | 1/1995 | Ing | 222/181.2 |

*Primary Examiner*—J. Casimer Jacyna
*Attorney, Agent, or Firm*—Bacon & Thomas, PLLC

[57] ABSTRACT

An improved extruding mechanism for auto soap dispenser which comprises, a soap dispenser equipped with an under outlet, a sleeve positioned underneath the dispenser, an output port locating at the bottom of the sleeve, and there is a valve seat which is installed inside the sleeve and therein sliding up and down, more particularly the valve seat consists of a disk block which includes several circulated holes and a mandrel, therefrom the mandrel on the top of valve seat is inserted with a spring and moreover the mandrel at the bottom of valve seat is equipped with a diaphragm; and there is a side tube positioned on the flank of sleeve and thereon connected to an extruding hose, and a link that pivoted at external end of the extruding hose is also pivoted by a motor driven eccentric wheel at its opposite end; according to the structure described above, the elastically reciprocating motion on the extruding hose which caused by motor driven eccentric wheel will put the squeeze on valve seat and then have it slid up and down and thus result in a corresponding motion to extrude the liquid soap out of the dispenser accordingly, by way of having an enclosed extruding hose so that the liquid soap is prevented from contacting air and so as not to dry out quickly, in addition it will force the diaphragm to cover closely onto the circulated holes locating in the valve seat and meanwhile the diaphragm would be able to be pressed down by spring force and hence to impact onto the outlet port that positioned on the sleeve and in this way preventing the liquid soap from leaking.

1 Claim, 3 Drawing Sheets

EXTRUDING MECHANISM FOR AUTO DISPENSER

FIELD OF THE INVENTION

The present invention relates to the field of an improved extruding mechanism for auto soap dispenser, and more particularly to the improved extruding mechanism preventing the liquid soap both from drying out and also from leaking.

BACKGROUND OF THE INVENTION

Normally, the toilet locating in the public place is equipped with wash basins for the people whenever used it washing their hands, and with the purpose of washing hands more conveniently it is equipped with auto soap dispensers on the wash basins; only that with general extruding mechanism equipped, its outlet should have wasted liquid soap that leaked out of the outlet of dispenser, which is a sleeve configuration, equipped at the outlet on soap dispenser, was made from soft and flexible material and wherein with one end there is a socket that connected/invaginated to the outlet of dispenser and at the opposite end, it is a layer of pellicle which has a slot on it; and while on extruding, the liquid soap should rush out of the slot locating on the pellicle, otherwise the slot should close up automatically while it stop extruding and hence liquid soap should stop leaking then.

However some time or other, due to losing its flexibility or maybe it has become aged gradually then in a way the slot would not be able to close properly again and hence start leaking; moreover this kind of sleeve configuration was invaginated onto dispenser only by means of its flexibility which in fact without utilizing any fixture at all and thus result in falling off very easily, and in light of the above defects we might say that this kind of sleeve configuration is not convenient at all and in fact needed to improve consequently.

In addition, this kind of extruding structure utilized a shuttling piston to extrude liquid soap, and also equipped with 2 check valves at the front end of cylinder and at the time while the check vale locating at the inlet for liquid soap is not using, then the steel ball inside the valve should fall down by its gravity and thereof the liquid soap in cylinder should contact the air and hence becomes hardened and sometime it was even too hardened to be extruded out of cylinder at all.

As can be seen, at the piston positioned in extruding structure and the cylinder, for the purpose on allowing the piston to shuttle freely, an appropriate gap then should be arranged at the place between cylinder and piston thereby, but thought just with a simple function in extruding liquid soap it is nothing like the precise configuration as the cylinder and piston which equipped in an engine, moreover if taking the cost into account actually it was not afford to design a precise configuration after all and thus result in leaking of the liquid soap from gap between piston and cylinder accordingly while using both the unprecise cylinder and piston.

In view of the defects from the anti-leaking structure with the known auto soap dispenser, the configuration of its sleeve is made from some kind of soft and flexible material, meanwhile it is equipped with a slot positioned at the outlet in order to prevent from leaking, but in fact it is very easy to become hardened and without function in preventing leaking which due to aging; further it is equipped with 2 check valves at the front end of cylinder, and at the time while the check vale locating at the inlet for liquid soap is not using, then the steel ball inside the valve should fall down by its gravity and thereof the liquid soap in the cylinder should contact the air and hence becomes hardened and sometime it was even too hardened to be extruded out of cylinder at all; in addition the known extruding structure is only designated for extruding liquid soap and without any precise configuration if taking the cost into account it was not afford to design a precise configuration after all and thus while using it the liquid soap will be able to transude through the gap between piston and cylinder and further leak out of the cylinder, and in fact there is a requirement for the improvement accordingly. The inventor, in view of the above, based on the quite remarkable foundation on designing and producing the relative products of soap dispenser equipment, thereby invented an improved extruding mechanism for auto soap dispenser comprising an under outlet at its bottom, a sleeve positioned underneath the dispenser, an output port locating at the bottom of the sleeve, and there is a valve seat which is installed inside the sleeve and therein sliding up and down, and more particularly the valve seat consists of a disk block which includes several circulated holes in it and on the circumference of the disk block there is an annular flange with its cross section tilting downward so as to couple tightly onto inner diameter of sleeve, moreover a mandrel is positioned at the center of disk block, therefrom the mandrel on the top of valve seat is inserted with a spring and meanwhile the mandrel at the bottom of valve seat is equipped with a diaphragm; in addition there is a side tube positioned on the flank of the sleeve and thereon connected to an extruding hose, and further a link that pivoted at external end of the extruding hose is also pivoted by a motor driven eccentric wheel at its opposite end; according to the structure described above, the elastically reciprocating motion on the extruding hose which caused by motor driven eccentric wheel will then put the squeeze on valve seat and then have it slid up and down and thus result in a corresponding motion to extrude the liquid soap out of the dispenser accordingly, moreover by way of having an enclosed extruding hose so that the liquid soap is prevented from contacting air and so as not to dry out quickly, in addition it will then force the diaphragm to cover closely on the circulated holes locating in the valve seat and meanwhile the diaphragm would be able to be pressed down by spring force hence to impact onto the outlet port that positioned on the sleeve and in this way preventing the liquid soap from leaking.

Thus, the preferred purpose of the invention is to provide a kind of auto soap dispenser which utilizes a particular extruding hose to extrude liquid soap out of dispenser and meanwhile preventing liquid soap from leaking as well.

According to an embodiment of the invention, it is desired to provide an auto soap dispenser wherewith a valve seat sliding up and down inside the sleeve and further to equip a diaphragm onto the bottom of valve seat in order to prevent liquid soap from leaking.

According to the further embodiment of the invention, it is desired to provide an auto soap dispenser comprising a valve seat positioned inside the sleeve and in addition, owing to the annular flange is positioned onto the circumference of disk block and further the annular flange is not only tilting downward but also flicking outward as well, and thus while the valve seat is sliding up and down then it would abut against the inner diameter of sleeve so that the liquid soap should not be refluent upward in the process of sliding motion from valve seat, or the internal portion of sleeve would become airtight while it stopped moving and thus in this way the liquid soap should be sealed thoroughly in the sleeve and thereby prevent it from leaking accordingly.

SUMMARY OF THE INVENTION

The present invention consists of an improved extruding mechanism for auto soap dispenser which comprises, a soap dispenser equipped with an under outlet, and a sleeve positioned underneath the dispenser, an output port locating at the bottom of the sleeve, and there is a valve seat which is installed inside the sleeve and therein sliding up and down, and more particularly the valve seat consists of a disk block which includes several circulated holes and a mandrel, therefrom the mandrel on the top of valve seat is inserted with a spring and in addition the mandrel at the bottom of valve seat is equipped with a diaphragm; and there is a side tube which positioned on the flank of sleeve and thereon connected to an extruding hose, and a link that pivoted at external end of the extruding hose is also pivoted by a motor driven eccentric wheel at the other end; according to the structure described above, the elastically reciprocating motion on the extruding hose which caused by motor driven eccentric wheel will then put the squeeze on valve seat and then have it slid up and down and thus result in a corresponding motion to extrude the liquid soap out of the dispenser accordingly, by way of having an enclosed extruding hose so that the liquid soap is prevented from contacting air and so as not to dry out quickly, furthermore it will force the diaphragm to cover closely on the circulated holes in the valve seat and meanwhile the diaphragm would be able to be pressed down by spring force hence to impact onto the outlet port that positioned on the sleeve and in this way preventing the liquid soap from leaking.

BRIEF DESCRIPTION OF THE DRAWINGS

The present invention, its configuration, structure, and operation will now be best further described in the following detailed description taken in conjunction with reference to the accompanying drawings in which.

DETAILED DESCRIPTION

Figure 1:
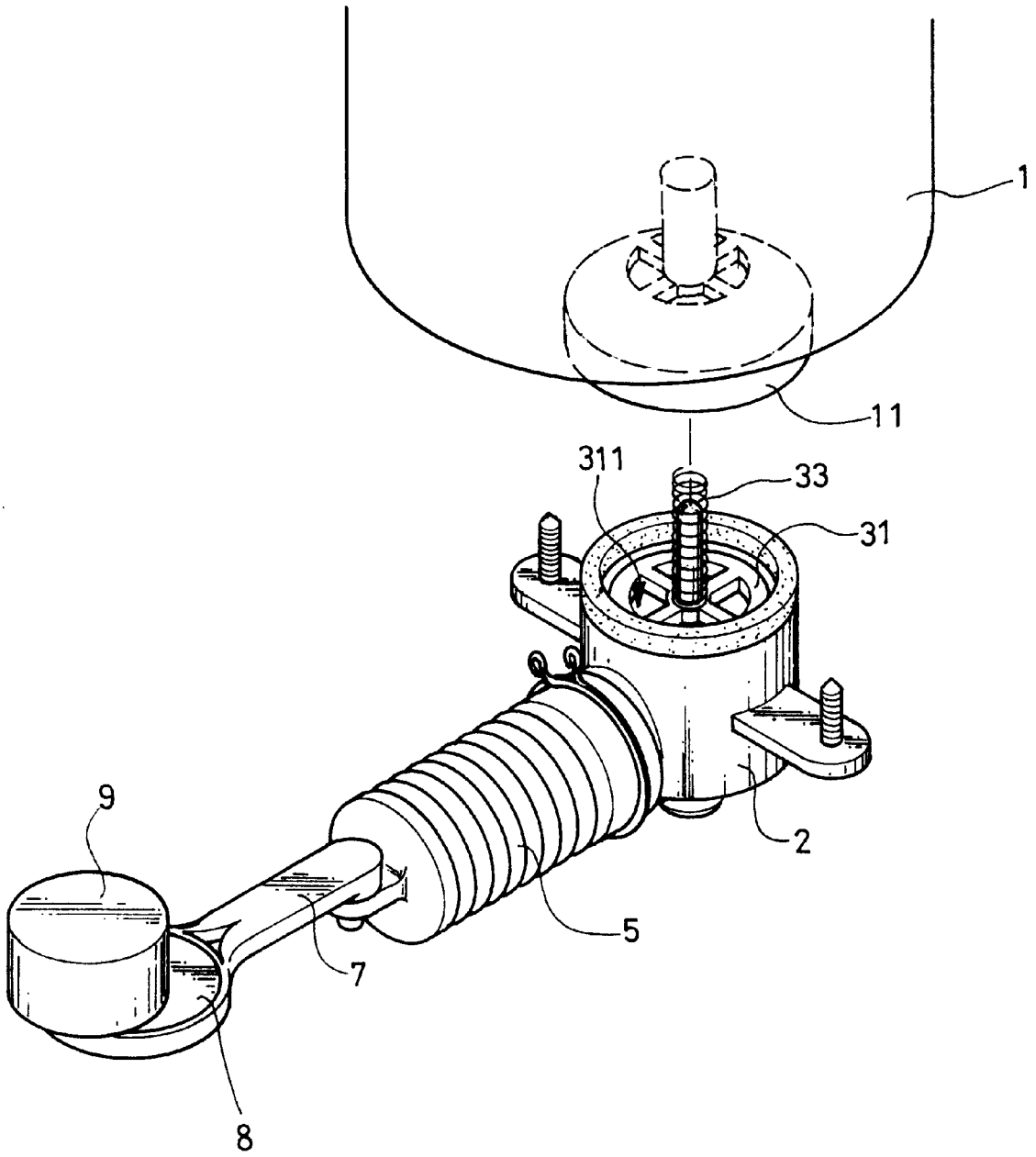
FIG. 1 is a perspective view of the present invention.
Figure 2:
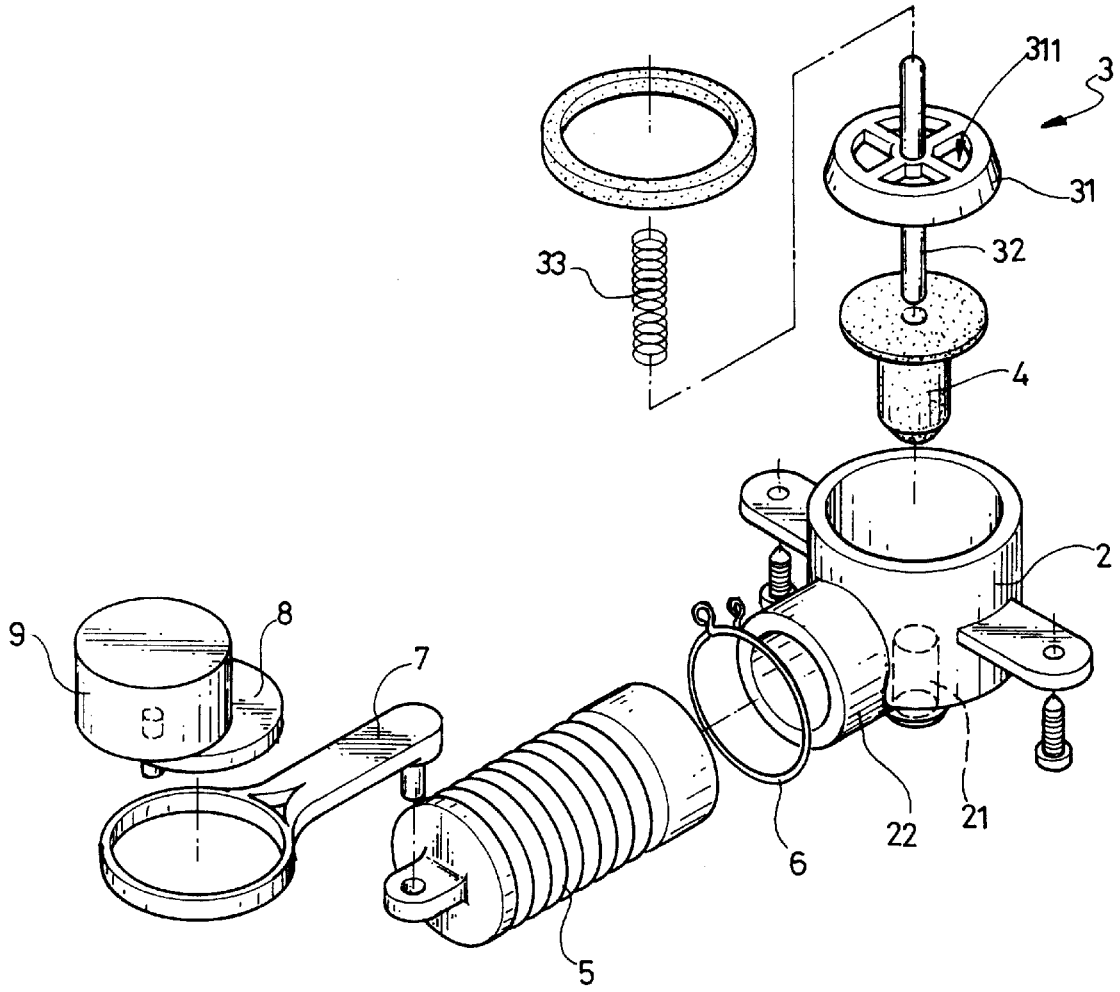
FIG. 2 is a perspective exploded view of the present invention.

Firstly, with reference to FIG. 1 and FIG. 2, the present invention comprises a soap dispenser 1 equipped with an under outlet 11, a sleeve 2 positioned underneath the outlet 11, also an output port 21 is then located at the bottom of the sleeve 2, and there is a valve seat 3 which is installed in the sleeve 2 and therein sliding up and down, more particularly the valve seat 3 is actually a disk block 31 which has several circulated holes 311 in it and around the disk block 31 there is an annular flange 312 with its cross section tilting downward so as to couple tightly onto inner diameter of sleeve 2, moreover a mandrel 32 is positioned at the center of disk block 31, therefrom the mandrel 32 on the top of valve seat 3 is inserted with a spring 33 and meanwhile the mandrel 32 at the bottom of valve seat 3 is equipped with a diaphragm 4, and thereby this diaphragm 4 compacted closely onto the bottom of circulated hole 311 which positioned inside the disk block 31 and there is a side tube 22 positioned on the flank of sleeve 2 and by utilizing a pinch cock 6 thereon the extruding hose 5 is connected with one of its end to the side tube 22, at the external end of the extruding hose 5 is enclosed and wherein there is a link 7 pivoted onto this enclosed end and furthermore at the other end, the link 7 is also pivoted onto an eccentric wheel 8 which is driven by a motor 9.

Figure 3:
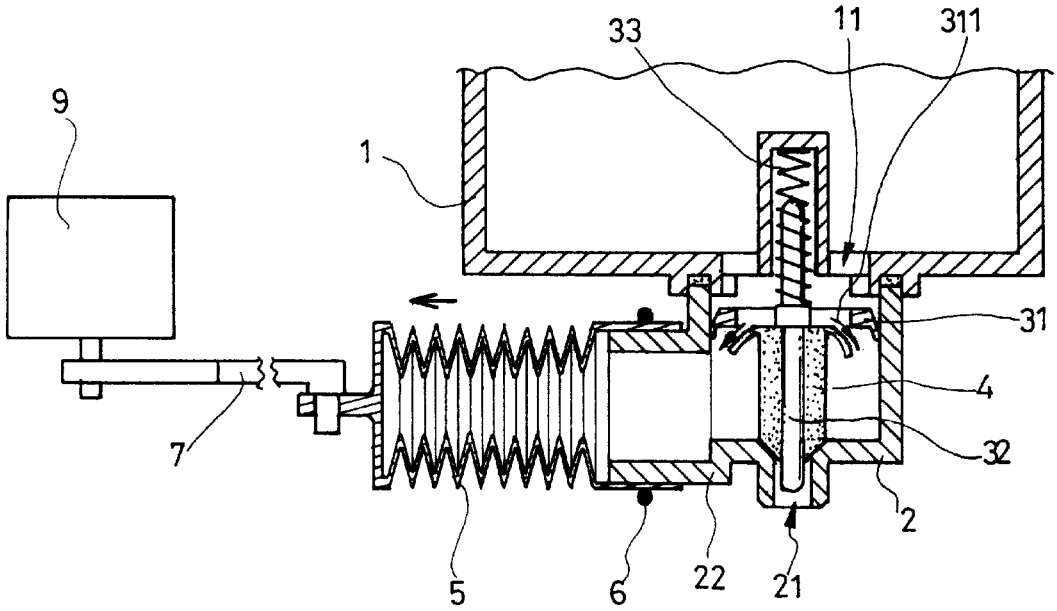
FIG. 3 is a cross section view (1) of another embodiment of the assembling status and corresponding motion according to the present invention.
Figure 4:
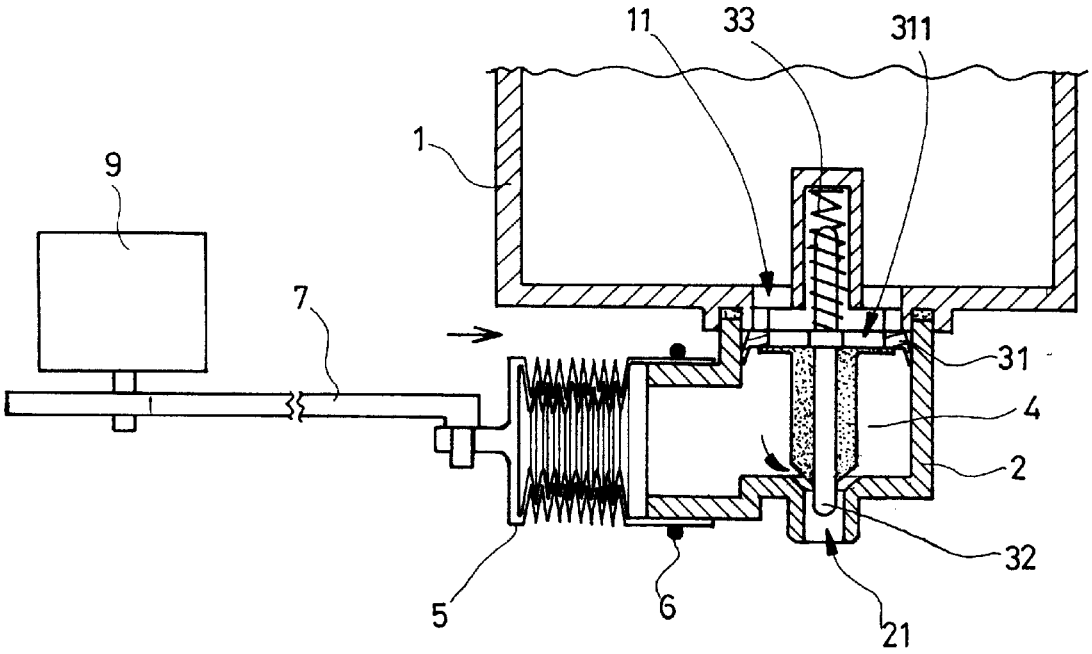
FIG. 4 is a cross section view (1) of another embodiment of the assembling status and corresponding motion according to the present invention.

According to the structure described above, as shown in FIG. 3 and FIG. 4 there is an embodiment of the present invention, the link 7 will swing reciprocatingly and then force the extruding hose 5 to have a reciprocating elasticity while the motor 9 driven eccentric wheel 8 is under revolving condition; at the time when extruding hose 5 extended outward it will produce a suction and so as to suck the valve seat 3 and hence moved downward and due to the vacuum suction the diaphragm 4 underneath the valve seat 3 would deviate downward and then leaf behind the circulated holes 311 positioned in the disk block 31, in addition, as pressed by the spring 33, thereby the bottom end of diaphragm 4 was impacted onto the lower outlet port 21 on the sleeve 2 and in order that the liquid soap was sucked into sleeve 2, which as shown in FIG. 3; and at the time while extruding hose 5 was squeezed inward then it would extrude valve seat 3 to go upward and thus make the diaphragm 4 at the bottom of disk block 31 against the position under the circulated hole 311 tightly but, in the meantime, the bottom of diaphragm 4 would not impact onto the outlet port 21 and therefore it would squeeze liquid soap out of the dispenser instead, which as shown in FIG. 4.

Seeing that the structure of extruding hose 5 is a flexible and enclosed hose body hence the liquid soap sucked into extruding hose 5 would not contact with external air and become hardened, so as to maintain the smooth operation on extruding; in addition, with the same enclosed structure for the extruding hose 5 therefore the liquid would not leak out of the hose while going on its elastically reciprocating motion accordingly.

As can be seen, owing to the annular flange 312 positioned on the disk block 31 of valve seat 3 should be impacted onto the inner diameter of sleeve 2 plus the annular flange 312 is not only tilting downward but also is flicking outward as well, thus while the valve seat 3 is sliding up and down then it would abut against inner diameter of sleeve 2 so that the liquid soap would not be refluent upward in the process of sliding motion from valve seat 3, or the internal portion of sleeve should become airtight while it stopped moving and thus in this way the liquid soap should be sealed in the sleeve thoroughly and thereby prevent it from leaking accordingly.

And further, if the lower portion of the valve seat 3 which positioned in the sleeve 2 did not use at all then the bottom of diaphragm 4 would be able to impact, by means of the elastic force from spring 33, onto lower outlet port 21 locating on the sleeve 2 and meanwhile the diaphragm 4 would able to squeeze against the position under the circulated hole 311 in the disk block 31, therefore, at the time while not using the dispenser then the liquid soap would be enclosed inside the sleeve 2 completely without leaking accordingly, besides, due to the liquid soap was kept away from the air thoroughly and thus so as not to become hardened at all and hence it would easily be extruded out of the soap dispenser without a doubt in next time while using it.

In view of the specific embodiment described herein, whereby are the preferred embodiments of the present invention only, all variation and modification of the invention hereby are intended to be covered by the spirit of the invention and the scope of the claims.

What is claimed is:

1. An improved extruding mechanism for an auto soap dispenser which comprises a soap dispenser equipped with an under outlet, a sleeve positioned underneath the outlet, an output port located at the bottom of the sleeve, a valve seat installed in the sleeve and therein sliding up an down, with the valve seat including a disk block which has several circulated holes, on the circumference of the disk block there is an annular flange with its cross section tilting downward so as to couple tightly onto the inner diameter of the sleeve, a mandrel is positioned at the center of the disk block, the mandrel on the top of the valve seat is inserted with a spring and the mandrel at the bottom of the valve seat is equipped with a diaphragm, the diaphragm is compacted closely onto the bottom of the circulated holes, a side tube is positioned on a flank of the sleeve and by utilizing a pinch cock thereon an extruding hose is connected with one of its ends to the side tube, an external end of the extruding hose is enclosed and a link pivoted onto this enclosed end, and, at its opposite end, the link is also pivoted onto an eccentric wheel which is driven by a motor.

* * * * *